US006446608B1

(12) United States Patent
Rizk

(10) Patent No.: US 6,446,608 B1
(45) Date of Patent: Sep. 10, 2002

(54) INJECTION DEVICE FOR A DIRECT-INJECTION INTERNAL COMBUSTION ENGINE

(75) Inventor: Reda Rizk, Köln (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/654,369

(22) Filed: Sep. 1, 2000

(30) Foreign Application Priority Data

Sep. 1, 1999 (DE) ..... 199 41 688

(51) Int. Cl.[7] ..... F02M 41/00
(52) U.S. Cl. ..... 123/467; 123/446
(58) Field of Search ..... 123/467, 506, 123/446, 459, 514; 137/516.27

(56) References Cited

U.S. PATENT DOCUMENTS 4,448,169 A * 5/1984 Badgley et al. ..... 123/467
4,459,086 A * 7/1984 Hafele et al. ..... 417/296
4,911,127 A * 3/1990 Perr ..... 123/446
5,033,506 A * 7/1991 Bofinger et al. ..... 137/516.27
5,067,880 A * 11/1991 Finsterwalder et al. ..... 417/495
5,161,572 A * 11/1992 Oberl et al. ..... 137/516.27
5,197,437 A * 3/1993 Dahlmann ..... 123/467
6,082,332 A * 7/2000 Hefler et al. ..... 123/446

FOREIGN PATENT DOCUMENTS

DE 585 014 9/1933
DE 38 12 867 C2 10/1989

* cited by examiner

*Primary Examiner*—Carl S. Miller
(74) *Attorney, Agent, or Firm*—Laurence A. Greenberg; Werner H. Stemer; Ralph E. Locher

(57) ABSTRACT

The injection device for a direct-injection internal combustion engine has an actuator and a piston connected to the actuator. A compression chamber connects to a high-pressure line. The device further includes an injection nozzle, a nozzle spring chamber, a nozzle chamber, a fuel supply line, and a pressure-relief valve. The pressure-relief valve draws a constant volume of fuel from the high-pressure line when it closes.

11 Claims, 3 Drawing Sheets

INJECTION DEVICE FOR A DIRECT-INJECTION INTERNAL COMBUSTION ENGINE

BACKGROUND OF THE INVENTION

Field of the Invention

The invention lies in the automotive technology field. More specifically, the present invention relates to an injection device for an internal combustion engine using direct injection. The injection device includes, in general, an actuator, a piston, a compression chamber, a high-pressure line, an injection nozzle, a nozzle chamber, a nozzle spring chamber, a fuel supply line, and a pressure-relief valve.

Injection devices of that type are known, for example, from German published patent application DE 196 12 737 A1. In prior art injection devices, which are controlled in particular by solenoid valves, the initial injection, its metering and its delineation from the main injection are important parameters for influencing the noise or exhaust-gas emission. The minimum injected amount is thereby governed by the speed of operation of the solenoid valve. However, the injected amount, which is predetermined by the long travel of the solenoid valve, is often too great to allow combustion optimization. In the German application DE 196 12 737, a valve is provided in the flow path between the high-pressure chamber and a shut-off control line. The valve is closed at the start of injection and opens only as a function of the pressure in the high-pressure chamber in a small pressure range after the start of injection, releasing the flow path for a short period. This results in an injection pressure which remains constant for a short period and has an advantageous effect on the injection profile. However, the minimum injected amount is still not influenced by this.

SUMMARY OF THE INVENTION

The object of the invention is to provide an injection device for a direct-injection internal combustion engine which overcomes the above-noted deficiencies and disadvantages of the prior art devices and methods of this kind, and in which the initial injected amount can be reduced.

With the above and other objects in view there is provided, in accordance with the invention, an injection device for an internal combustion engine using direct injection, comprising:

- an actuator and a piston connected to the actuator;
- an injection device body-having a pressure chamber formed therein and a high-pressure line communicating with the pressure chamber;
- an injection nozzle disposed in a nozzle chamber formed in the injection device body and communicating with a fuel supply line;
- a pressure-relief valve disposed to communicate with the high-pressure line and to draw a constant volume of fuel from the high-pressure line upon closing.

In accordance with an added feature of the invention, the pressure-relief valve is disposed in a flow path between the fuel supply line and the pressure chamber.

In accordance with an additional feature of the invention, the pressure-relief valve comprises a piston movably disposed in a cylindrical bore, the bore having a first portion with a larger inner diameter and a second portion with a smaller inner diameter, and a conical step transition from the larger inner diameter to the smaller inner diameter; the piston having an upper, conically expanding segment and a ring segment below the upper segment, the ring segment sealing against an inner wall surface bounding the second portion of the bore, and wherein, during a downward movement of the piston, the conically expanding segment coming to be seated on the step transition.

In accordance with another feature of the invention, a lower segment of the piston, adjacent the ring segment, is formed with longitudinal grooves in an outer circumference thereof.

In accordance with again another feature of the invention, a lower segment of the piston, adjacent the ring segment, is formed with a central longitudinal hole and transverse holes adjacent thereto.

In accordance with a further feature of the invention, the fuel supply line opens into the cylindrical bore in a region of the lower segment of the piston.

With the above and other objects in view there is further provided, in accordance with the invention, an injection device for an internal combustion engine using direct injection, comprising:

- an actuator;
- a piston connected to the actuator;
- an injection device body having a pressure chamber formed therein and a high-pressure line communicating with the pressure chamber;
- an injection nozzle disposed in a nozzle chamber formed in the injection device body and communicating with a nozzle spring chamber and a fuel supply line; and
- a pressure-relief valve disposed to draw a constant volume of fuel to the nozzle spring chamber upon closing, whereby the volume produces nozzle needle damping during opening of the injection nozzle.

It is thus possible to use a prior art pressure valve with constant-volume pressure relief for the pressure-relief valves, as is used for in-line injection pumps. It is thus possible to use a conventional type of pressure valve without any need for redesign.

Other features which are considered as characteristic for the invention are set forth in the appended claims.

Although the invention is illustrated and described herein as embodied in a injection device for an internal combustion engine using direct injection, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
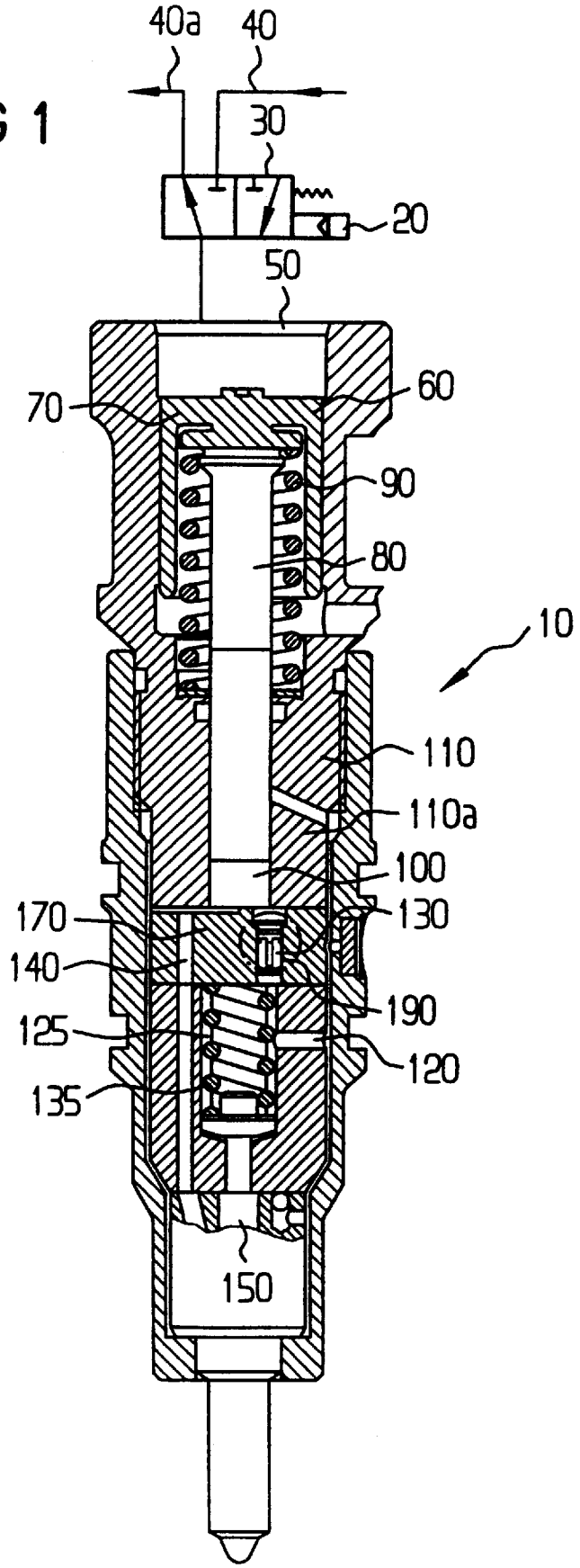
FIG. 1 is a section taken through an injection device according to the invention.

Referring now to the figures of the drawing in detail and first, particularly, to FIG. 1 thereof, there is seen an injection device 10 for an internal combustion engine using direct injection. The injection device 10 has a solenoid 20 for operating a control valve 30. In the preferred embodiment, the valve 30 is a 3/2-way valve that releases or interrupts the flow connection between a control line 40 and a medium-pressure chamber 50, and in the same way but in the opposite sense interrupts or releases the flow connection between a leakage-oil line 40*a* and the medium-pressure chamber 50.

The control line 40 originates from a hydraulic reservoir, which is not shown in any more detail and is at medium pressure. The leakage-oil line 40*a* opens into a leakage-oil container. Adjacent to the medium-pressure chamber 50 there is a hydraulic booster piston 60, which has a medium-pressure piston 70 and a high-pressure piston 80. The hydraulic booster piston 60 is held in the rest position via a spring 90.

Adjacent to the end of the high-pressure piston 80 there is a high-pressure chamber 100, which is formed by the high-pressure piston 80 and the high-pressure cylinder 110. The high-pressure chamber 100 is connected to a fuel supply line 120, which is connected to a fuel supply system. The fuel supply line 120 opens into a nozzle spring chamber 125, in which a spring 135 is disposed. The spring 135 biases a nozzle needle 150 into the closed position. A pressure-relief valve 130 is arranged between the nozzle spring chamber 125 and the high-pressure chamber 100. Furthermore, the high-pressure chamber 100 is connected via a high-pressure line 140 to a nozzle chamber, which surrounds the nozzle needle 150.

The pressure-relief valve 130 is disposed in a housing section 170 between the high-pressure chamber 100 and the fuel supply line 120. With reference to the more detailed illustration of FIG. 2, the pressure-relief valve 130 comprises a pressure-relief piston 180, which is held in a cylindrical bore 190 such that it can be moved. The cylindrical bore 190 has an inner diameter d and expands in its upper region, close to the high-pressure chamber 100, via a conical step 200 to an inner diameter D.

Figure 2:
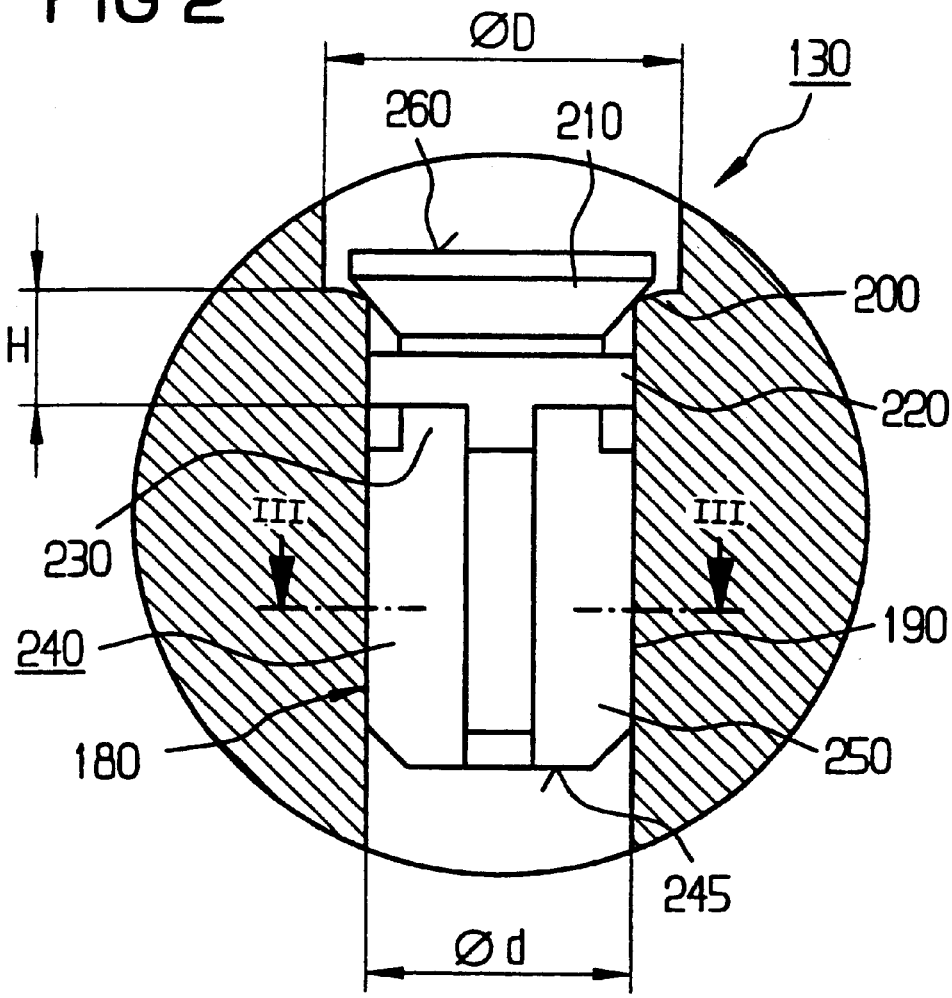
FIG. 2 is an enlarged illustration of a pressure-relief valve used in the injection device shown in FIG. 1.
Figure 3:
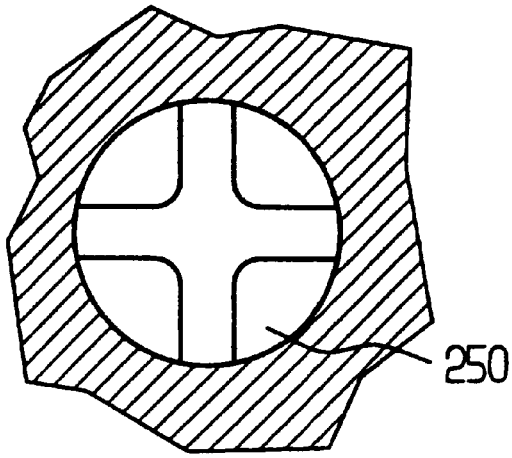
FIG. 3 is a section taken along the line III—III in FIG. 2.

In its upper region, close to the high-pressure chamber 100, the pressure-relief piston 180 has a conically expanding segment 210. When the pressure-relief valve 130 is in the closed position—as shown in FIG. 2—in which the pressure-relief piston 180 has been moved downward in the cylindrical bore 190, it is seated by means of the section 210 on the conical step 200. Underneath the conically running section 210, the pressure-relief piston 180 has a ring section 220 whose external diameter corresponds to the inner diameter d of the cylindrical bore 190. Adjacent to the ring section 220 there is a piston section 230 whose external diameter is smaller than that of the ring section 220. The piston section 230 is in turn adjacent to a lower piston section 240, whose external diameter corresponds to that of the ring section 220. The piston section 240 has longitudinal grooves 250 (FIG. 3) which are spaced apart in the circumferential direction and open into the piston section 230.

The pressure-relief valve 130 in the injection device 10 operates as follows:

The fuel passes via the fuel supply line 120 and the nozzle chamber 125 into the area of the lower end surface 245 of the pressure-relief piston 180 of the pressure-relief valve 130. Owing to the pressure difference between the supply line 120 and the high-pressure chamber 100, the pressure-relief piston 180 is moved upward into an open position, in which the flow path between the fuel supply line 120 and the high-pressure chamber 100 is released. If the solenoid 20 is now operated by application of a switching pulse, movement of the control valve 30 results in the medium-pressure chamber 50 above the medium-pressure piston 70 being connected to the control line 40. The hydraulic booster piston 60 is then moved downward. The movement results in a pressure rise in the high-pressure chamber 100. As soon as the pressure in the high-pressure chamber 100 exceeds the pressure in the fuel supply line 120, the pressure-relief piston 180 is moved by the pressure which is exerted on the upper end surface 260 of the piston section 210 so far downward in the cylindrical bore 190 that the ring section 220 of the pressure-relief piston 180 passes over the step 200 in the cylindrical bore 190, which then interrupts the fuel flow path.

Owing to the rising pressure in the high-pressure chamber 100, the pressure-relief piston 180 is then moved farther downward, until the conical segment 210 is seated on the step 200 in the cylinder 190. This subsequent, second downward movement of the pressure-relief valve 180 results in the high-pressure line 140, which is connected to the high-pressure chamber 100, drawing a constant volume of fuel, which corresponds to $$\frac{H \cdot \pi \cdot d^2}{4}$$

(where H=distance between the lower edge of the ring section 220 and the contact point between the conical section 210 of the pressure-relief piston 180 and the step 200). The pressure-relief valve 130 is now completely closed, and the pressure-relief piston 180 is in its lowermost position. Pressure now builds up further in the high-pressure chamber 100 until the pressure in the nozzle chamber, which is connected to the high-pressure chamber 100 via the high-pressure line 140, reaches a level that is sufficient to lift the nozzle needle 150 out of its seat. The injection process then starts with a fuel volume which is reduced by a defined volume as a result of the pressure-relief valve 130 being completely seated. The injected amount when the injection nozzle is opened is reduced by this defined fuel volume.

Figure 4:
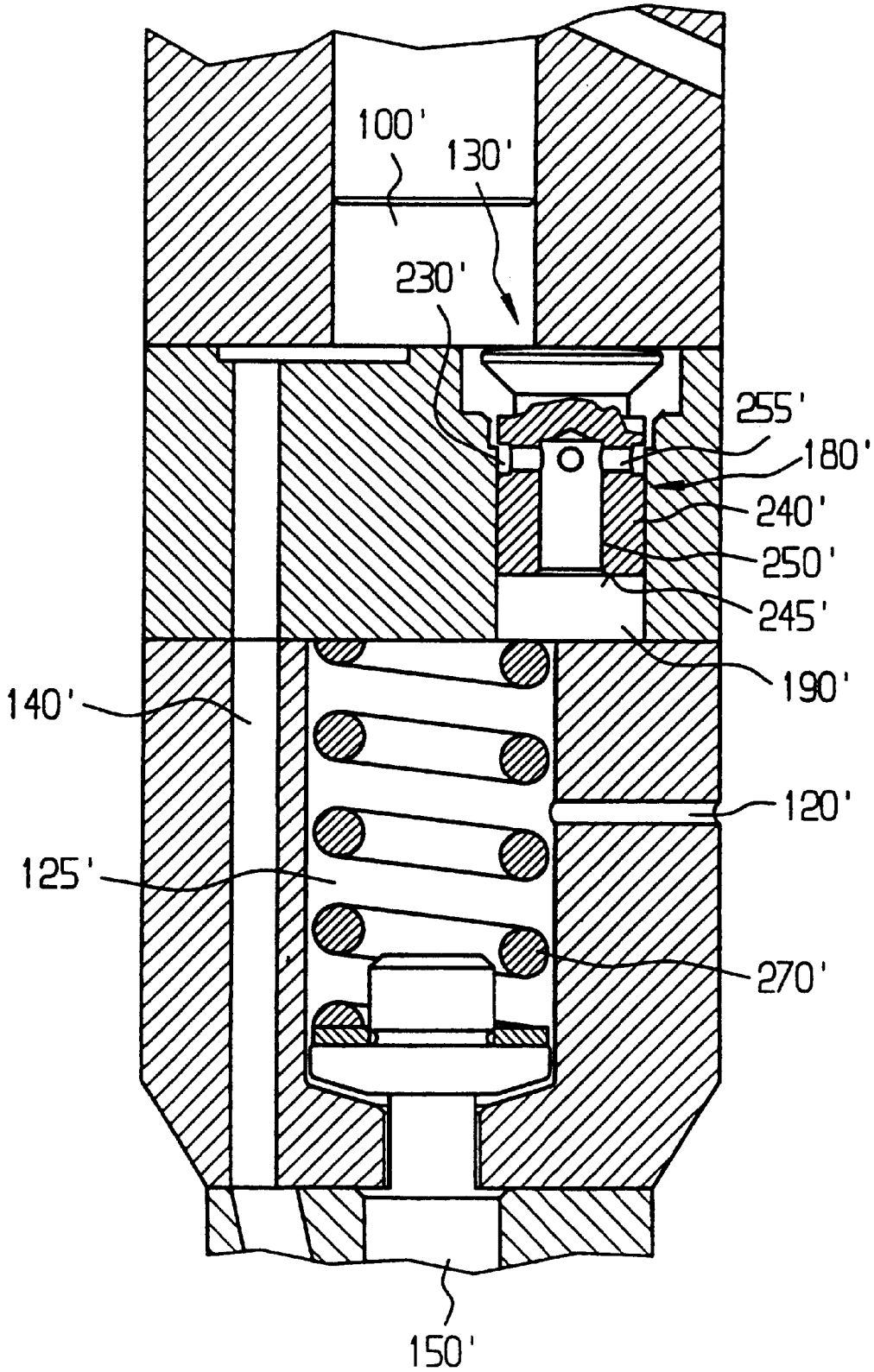
FIG. 4 is an enlarged illustration of a further embodiment of a pressure-relief valve.

In an alternative embodiment (FIG. 4), the pressure-relief valve 130' comprises a pressure-relief piston 180' whose lower section 240' is designed to have a central longitudinal hole 250', which opens into two transverse holes 255', which are arranged at right angles to one another and in turn open into the piston section 230' having a reduced external diameter. The fuel is in this case once again supplied into the cylindrical bore 190' in the region of the lower end surface 245' of the pressure-relief piston 180'. The fuel supply line 120' opens into the nozzle spring chamber 125'.

When the pressure-relief piston 180, 180' is seated and the volume of fuel is at the same time drawn from the high-pressure line 140, 140', this volume of fuel which is drawn passes into the chamber 125, 125' and produces nozzle needle damping during the opening of the nozzle.

I claim:

1. An injection device for an internal combustion engine using direct injection, comprising:

an actuator;

a piston connected to said actuator;

an injection device body having a pressure chamber formed therein and a high-pressure line communicating with said pressure chamber;

an injection nozzle disposed in a nozzle chamber formed in said injection device body and communicating with a fuel supply line;

a pressure-relief valve disposed to communicate with said high-pressure line and to draw a constant volume of fuel from said high-pressure line before closing;

said pressure-relief valve having a piston movably disposed in a cylindrical bore;

said bore having a first portion with a larger inner diameter and a second portion with a smaller inner diameter, and a conical step transition from the larger inner diameter to the smaller inner diameter; and said piston having an upper, conically expanding segment and a ring segment below said upper segment, said ring segment sealing against an inner wall surface bounding said second portion of said bore, and during a downward movement of said piston, said conically expanding segment coming to be seated on said step transition.

2. The injection device according to claim 1, wherein said pressure-relief valve is disposed in a flow path between said fuel supply line and said pressure chamber.

3. The injection device according to claim 1, wherein a lower segment of said piston, adjacent said ring segment, is formed with longitudinal grooves in an outer periphery thereof.

4. The injection device according to claim 3, wherein said fuel supply line opens into said cylindrical bore in a region of said lower segment of said piston.

5. The injection device according to claim 1, wherein a lower segment of said piston, adjacent said ring segment, is formed with a central longitudinal hole and transverse holes adjacent thereto.

6. The injection device according to claim 5, wherein said fuel supply line opens into said cylindrical bore in a region of said lower segment of said piston.

7. An injection device for an internal combustion engine using direct injection, comprising:

an actuator;

a piston connected to said actuator;

an injection device body having a pressure chamber formed therein and a high-pressure line communicating with said pressure chamber;

an injection nozzle disposed in a nozzle chamber formed in said injection device body and communicating with a nozzle spring chamber and a fuel supply line;

a pressure-relief valve disposed to draw a constant volume of fuel to said nozzle spring chamber before closing, the volume producing nozzle needle damping during opening of said injection nozzle;

said pressure-relief valve having a piston movably disposed in a cylindrical bore;

said bore having a first portion with a larger inner diameter and a second portion with a smaller inner diameter , and a conical step transition from the larger inner diameter to the smaller inner diameter; and said piston having an upper, conically expanding segment and a ring segment below said upper segment, said ring segment sealing against an inner wall surface bounding said second portion of said bore, and wherein, during a downward movement of said piston, said conically expanding segment coming to be seated on said step transition.

8. The injection device according to claim 7, wherein a lower segment of said piston, adjacent said ring segment, is formed with longitudinal grooves in an outer periphery thereof.

9. The injection device according to claim 8, wherein said fuel supply line opens into said cylindrical bore in a region of said lower segment of said piston.

10. The injection device according to claim 7, wherein a lower segment of said piston, adjacent said ring segment, is formed with a central longitudinal hole and transverse holes adjacent thereto.

11. The injection device according to claim 10, wherein said fuel supply line opens into said cylindrical bore in a region of said lower segment of said piston.

* * * * *